US007494244B1

(12) United States Patent
Van Diep et al.

(10) Patent No.: US 7,494,244 B1
(45) Date of Patent: Feb. 24, 2009

(54) SERIALLY CONTROLLABLE LED LIGHTING SYSTEMS

(75) Inventors: Alan Van Diep, Foothill Ranch, CA (US); Lawrence Michael Johnson, Laguna Niguel, CA (US)

(73) Assignee: J & J Electronics, Inc., Irvine, CA (US)

( * ) Notice: Subject to any disclaimer, the term of this patent is extended or adjusted under 35 U.S.C. 154(b) by 391 days.

(21) Appl. No.: 11/316,419

(22) Filed: Dec. 21, 2005

(51) Int. Cl.
*F21V 33/00* (2006.01)

(52) U.S. Cl. ..... 362/234; 362/227; 362/640; 362/645; 362/646; 362/800; 439/502

(58) Field of Classification Search ..... 362/227, 362/234, 235, 236, 237, 640, 645, 646, 647, 362/652, 800, 308, 326; 439/502, 578, 490, 439/460; 174/152 R, 363
See application file for complete search history.

(56) References Cited

U.S. PATENT DOCUMENTS

| | | | | |
|---|---|---|---|---|
| 3,610,914 | A | 10/1971 | Blackwell | |
| 4,115,844 | A | 9/1978 | Bull et al. | |
| 4,126,774 | A | 11/1978 | Gossling | |
| 4,935,856 | A | 6/1990 | Dragoon | |
| 5,368,503 | A * | 11/1994 | Savage, Jr. | 439/502 |
| 5,797,767 | A | 8/1998 | Schell | |
| 2002/0141196 | A1 * | 10/2002 | Camarota et al. | 362/372 |

FOREIGN PATENT DOCUMENTS

| | | |
|---|---|---|
| JP | 5334904 | 12/1993 |
| JP | 10134897 | 5/1998 |

* cited by examiner

*Primary Examiner*—Laura Tso
(74) *Attorney, Agent, or Firm*—Stout, Uxa, Buyan & Mullins LLP; Robert D. Buyan

(57) ABSTRACT

A surface-mounted lighting system and method wherein a lamp (e.g., an LED) is mounted within a surface (e.g., a wall, the wall of a pool or spa, a panel, etc.) such that it casts light to one side of the surface. A lighting system of the present invention comprises a) a lens cap/light emitting diode/first connector subassembly and b) a second connector/wire subassembly. A first connector located on the lens cap/light emitting diode/first connector subassembly is connectable to the second connector located on the second connector/wire subassembly such that power may be delivered through the second connector/wire subassembly to the lamp. Thereafter, when it is desired to remove or change the lamp, the first connector is disconnected from the second connector and the entire Lens cap/LED/first connector subassembly may be removed and replaced. In this manner, the lamp may be changed from a front or exposed side surface of a wall in which the lamp is mounted without the need to access wiring that is concealed or enclosed behind or on the opposite side of that wall.

20 Claims, 6 Drawing Sheets

SERIALLY CONTROLLABLE LED LIGHTING SYSTEMS

FIELD OF THE INVENTION

The present invention relates generally to lighting systems and methods and more particularly to surface mounted lighting systems and methods that use light sources such as light emitting diodes (LEDs).

BACKGROUND

Various forms of lighting that use light emitting diodes (LED) light sources have recently been introduced. LEDs have a long life compared to other lamps, have a smaller physical form, operate on low voltage, are durable and allow digital addressing among other benefits. LEDs are primarily used in mobile appliances, signage, displays, architectural, transportation and consumer applications.

LEDs with their unique attributes have been introduced in applications not possible with other lamps before. However, some of the unique attributes, in turn, contribute to shortcomings in some other areas. For instance, because of the small physical form, lamp replacement (LED replacement) may be difficult where the LED assemblies are in an enclosed, confined or hard-to access.

The present invention relates to LED lamp replacement for LEDs assemblies that are mounted on a surface such as instrument panels, swimming pool, spa, pond, whirlpool, hot tub, shower, steam room, bath tub, jetted bath tub, water fall, fountain or other structure that contains or receives water or other fluid.

More specifically the present invention relates to LED lamp replacement in situations (constructions) where it is impractical to replace an LED lamp from the rear or underside of a panel, wall or other structure.

Surface mounted LED lighting systems of the prior art have addressed the problems associated with replacing the LED light source in various ways, including the use of specialized lenses, sockets and/or sleeves that may render such assemblies complicated and/or cumbersome. Also, in applications where space behind or below the surface is limited, it may be difficult to assure that proper connections are made when changing the LED because the terminals of the LED are situated relatively close to the rear or underside of the surface. Some examples of prior art surface-mounted lamp assemblies are as follows:

Taiwanese Patent Publication 0538547B entitled "Surface Mounted LED Lamp Package" describes a surface mounted LED system and methods for replacement of its LEDs.

Japanese Patent Publication 10134897A2 entitled "Modular Jack with Indicator Light" describes an LED replacement method wherein a panel that holds the LEDs is pulled away from a housing to enable LED replacement.

Japanese Patent Publication 5334904A2 entitled "Pilot Lamp for Printed Board" describes a system wherein a panel-mounted lens is disposed on a top plate and the LEDs are mounted on a bottom plate and the top plate is separable from the bottom plate to allow LED replacement.

U.S. Pat. No. 4,126,774 entitled "Electrically Illuminated Push-Buttons and Indicators" describes a lens with associated sleeves and a lamp mounted under the lens.

U.S. Pat. No. 4,115,844 entitled "Lamp Assembly" describes a lamp assembly and associated bulb socket structure as well as a related lens wherein the lamp can be removed and replaced from either end of the assembly.

U.S. Pat. No. 3,610,914 titled "Illuminated Indicating Instrument with Front Replacement Lamps" describes a casing a having illuminating lamps within the casing. The sockets for the lamps remain in the instrument, the removed lamps being readily accessible for replacement without requiring dismantling of the instrument casing.

Also, a number of surface mounted lamp assemblies of the prior art have used lenses that screw onto the body of the lamp assembly. In such assemblies, because of the thread lead, it can be difficult to tighten the lens onto the body and at the same time be assured that the lens will assume a particular desired position.

There remains a need in the art for the development of new surface mountable lamp assemblies that provide for easy lamp replacement.

SUMMARY OF THE INVENTION

In general, the present invention provides a highly versatile surface mounted lighting system, for example, for use in a pool, spa or other structure where a display of light, for example, a serial display of light of various colors, patterns, etc. would be desirable. More specifically, the present invention provides a light emitting diode system which generally comprises a junction hub comprising a hub body having a circuit board, and a plurality of connectors, for example, first, second and third connectors. The system is structured to be installed in a panel, wall, or other structure. For example, the panel, wall or other structure may comprise a side, top or bottom wall of a swimming pool, spa, pond, whirlpool, hot tub, shower, steam room, bath tub, jetted bath tub, water fall, fountain or other structure that contains or receives vapor, water or other fluid.

In accordance with one embodiment of the invention, the first connector of the junction hub is connected, for example, removably connected, to a signal transmission cable that transmits a signal, for example from a controller, to the junction hub. The second connector is connected, for example, removably connected to a light emitting diode subassembly. The third connector may be connected, for example removably connected, to one of a light emitting diode subassembly and a signal transmission cable, for example, a signal transmission cable that transmits the signal from the junction hub to another junction hub that has at least one other light emitting diode connected thereto.

Further in accordance with the invention, the circuit board of the junction hub is operative to cause the light emitting diodes to display light, for example, serially, from the light emitting diodes of the system. The controller may be a computer that is programmed or programmable to send instructions to the circuit board to cause the light emitting diodes connected to the junction hub to operate in a pre-programmed manner, for example, for a specific period of time, in a particular order, with a particular level of brightness, and/or in accordance with any other programmable parameter.

Still further in accordance with the invention, the light emitting diode subassembly comprises a lens member, for example, a generally tubular lens body having a closed distal end, for example in the form of a cap, and an open proximal end. The light emitting diode subassembly further comprises a plug member having a distal end and a proximal end, and a light emitting diode protruding from the distal end of the plug member. The light emitting diode subassembly further comprises a connector cable attached to the proximal end of the plug member. The cable is operatively connectable to the junction hub, for example, by means of the first or second connectors of the junction hub. In one aspect of the invention, the plug member and light emitting diode are both insertable into the tubular lens body such that the plug member engages, for example frictionally engages, the inner surface of the tubular lens body. When the light emitting diode is inserted into the tubular lens body, it will cast light outwardly through the closed distal end of the lens body. For example, the closed distal end of the lens body may comprise a clear or translucent surface. Advantageously, the plug member engages the tubular lens body to form a substantially liquid tight seal therebetween.

Still further in accordance with the invention, in some embodiments, the plug member has a distal portion which may be insertable into the lens body and a basal portion against which the proximal end of the lens body abuts or bottoms out when the distal portion of the plug member may be inserted therein. The connector cable of the light emitting diode subassembly extends through the basal portion of the plug member.

In another aspect of the invention, the basal portion of the plug member may be structured to perform a strain relief function to deter damage to or breakage of the connection between the connector cable and the light emitting diode. For example, the basal portion may be an enlarged portion of the plug member and/or may have a degree of flexibility effective to absorb bending strain of which the light emitting diode subassembly may be subjected during installation or maintenance of the present system.

The light emitting diode subassembly may further comprise a connector circuit extending substantially through the plug member and providing an electrical connection between the connector cable and the light emitting diode.

In yet another aspect of the invention, the light emitting diode subassembly may include a heat dissipater or heat dissipating structure for dissipating heat from the light emitting diode during use of the system. For example, the heat dissipater may comprise an opening or vent passage on the lens member, for example, at a location of the lens member adjacent to the light emitting diode.

In yet another aspect of the invention, the system includes a plurality of light emitting diode subassemblies connectable to one or more junction hubs. The components of the system can be electrically interconnected to provide a desired number of lights and a desired serial operation thereof. In some embodiments, one or more of the light emitting diodes are monochromatic. Alternatively or additionally, one or more of the light emitting diodes may be capable of emitting light of different colors. Further, the circuit board of the junction hub is operative to serially control the color of light emitted from the light emitting diodes. For example, the light emitting diodes may comprise red-green-blue light emitting diodes.

In a more specific aspect of the present invention, at least one of the first, second and third connectors of the junction hub comprises a multiple pin male/female connector, plug, receptacle or other electrically conductive connective structure. The light emitting diode subassembly connector comprises a mating or corresponding connector that enables the subassembly to be "plugged in" to the hub connector without requiring any splicing or wiring steps to achieve the electrical connection between the junction hub and the light emitting diode subassembly. In an exemplary embodiment, all of the first, second and third connectors of the junction hub are substantially identical. Thus, when it is desired to remove or change the light emitting diode in the installed system, the first connector may be disconnected from the second connector and the entire light emitting diode subassembly may be removed and replaced. In some embodiments, a bulb or other light source may be substituted for the light emitting diode, and the term light emitting diode, or LED, as used herein shall be construed broadly to include other non-LED light sources such as light bulbs.

Further details of the invention and specific examples of applications of the invention are shown in the accompanying drawings and described herebelow.

DETAILED DESCRIPTION

Figure 1:
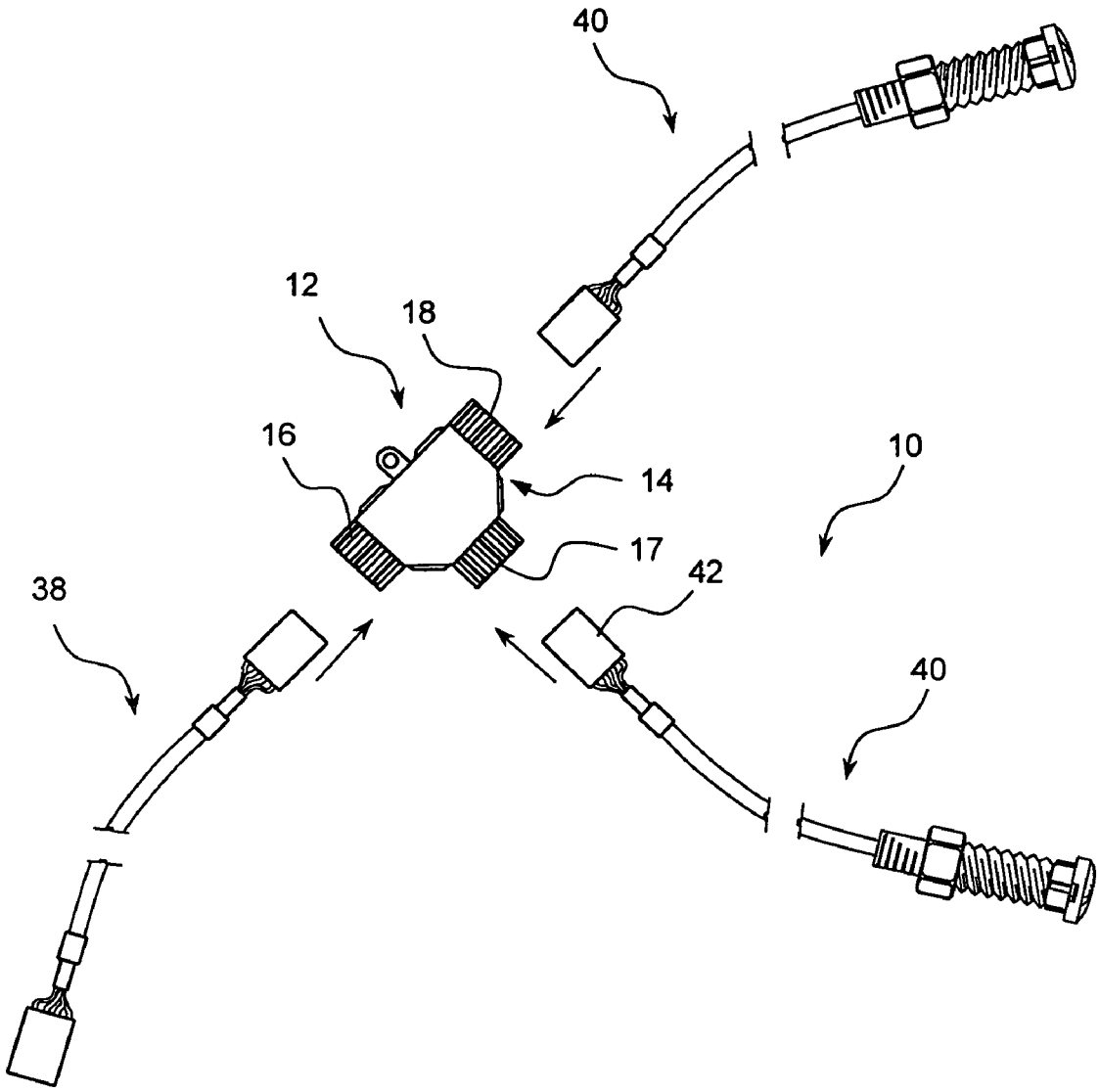
FIG. 1 is a top view of a system in accordance with the invention, the system including a junction hub, a signal transmission cable, a first light emitting diode subassembly and a second light emitting diode subassembly.
Figure 2:
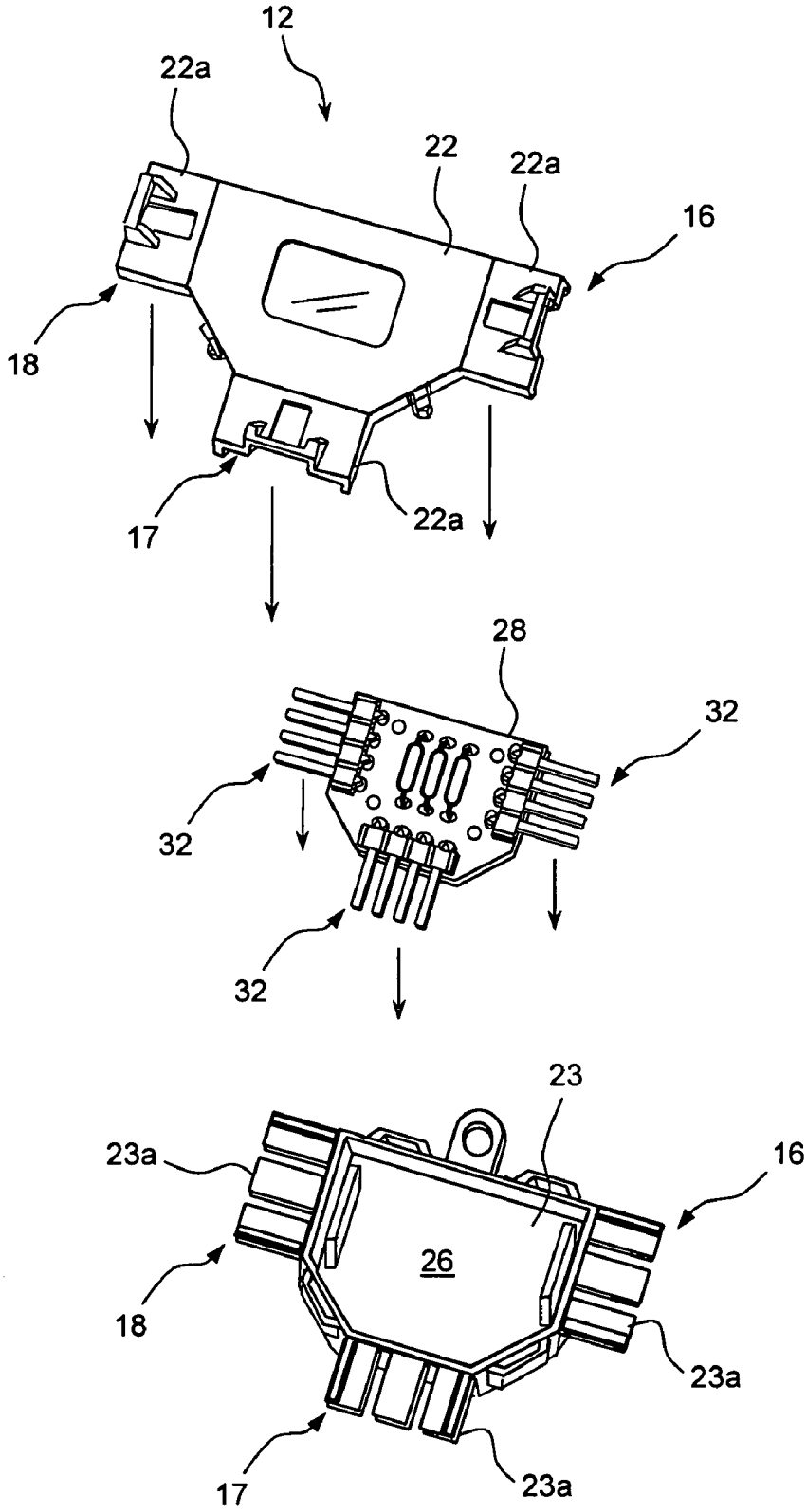
FIG. 2 is an exploded view of the junction hub shown in FIG. 1.

Referring now to FIG. 1, a system in accordance with the present invention is shown generally at 10. The system 10 generally comprises a junction hub 12 comprising a hub body 14 having a plurality of electrically connectors, for example, first, second and third connectors 16, 17, 18. Turning briefly to FIG. 2, the hub body 14 of the junction hub 12 is shown in exploded view. Hub body 14 may comprise first and second base portions 22, 23 which, when assembled, form a shallow cavity 26 containing a circuit board 28. Connectors 16, 17, 18 may be identical to one another. Connectors 16, 17, 18 are formed from protruding tabs portions 22*a* and 23*a* of base portions 22, 23 respectively, and contain electrically conductive prongs 32 of the circuit board 28.

Turning back now to FIG. 1, the first connector 16 is connectable to a signal transmission cable 38 that is effective to transmits a signal, for example, from a signal transmitter and/or a controller unit (not shown in FIG. 1) to the junction hub 12. The second and third connectors 17, 18 are each connectable to a light emitting diode subassembly 40, to be described in greater detail elsewhere herein.

In the configuration of the system 10 shown in FIG. 1, the junction hub 12, upon receiving a signal from the signal transmission line 38, causes or controls activation of light emitting diodes located at a distal end of each light emitting diode subassembly 40. For example, the circuit board of the junction hub 12 functions to cause the light emitting diode subassemblies 40 to display light.

Connectors 16, 17 and 18 of the junction hub 12 may comprise any suitable structure, for example, but not limited to, a single or multiple pin male or female connector, a plug, receptacle, or other suitable connective structure. The light emitting diode subassembly includes a connector 42 that enables the subassembly to be manually "plugged in" to one of the junction hub connectors 16, 17, 18, preferably without requiring splicing or other wiring steps to achieve an electrical connection between the junction hub 12 and the light emitting diode subassembly 40.

Figure 3:
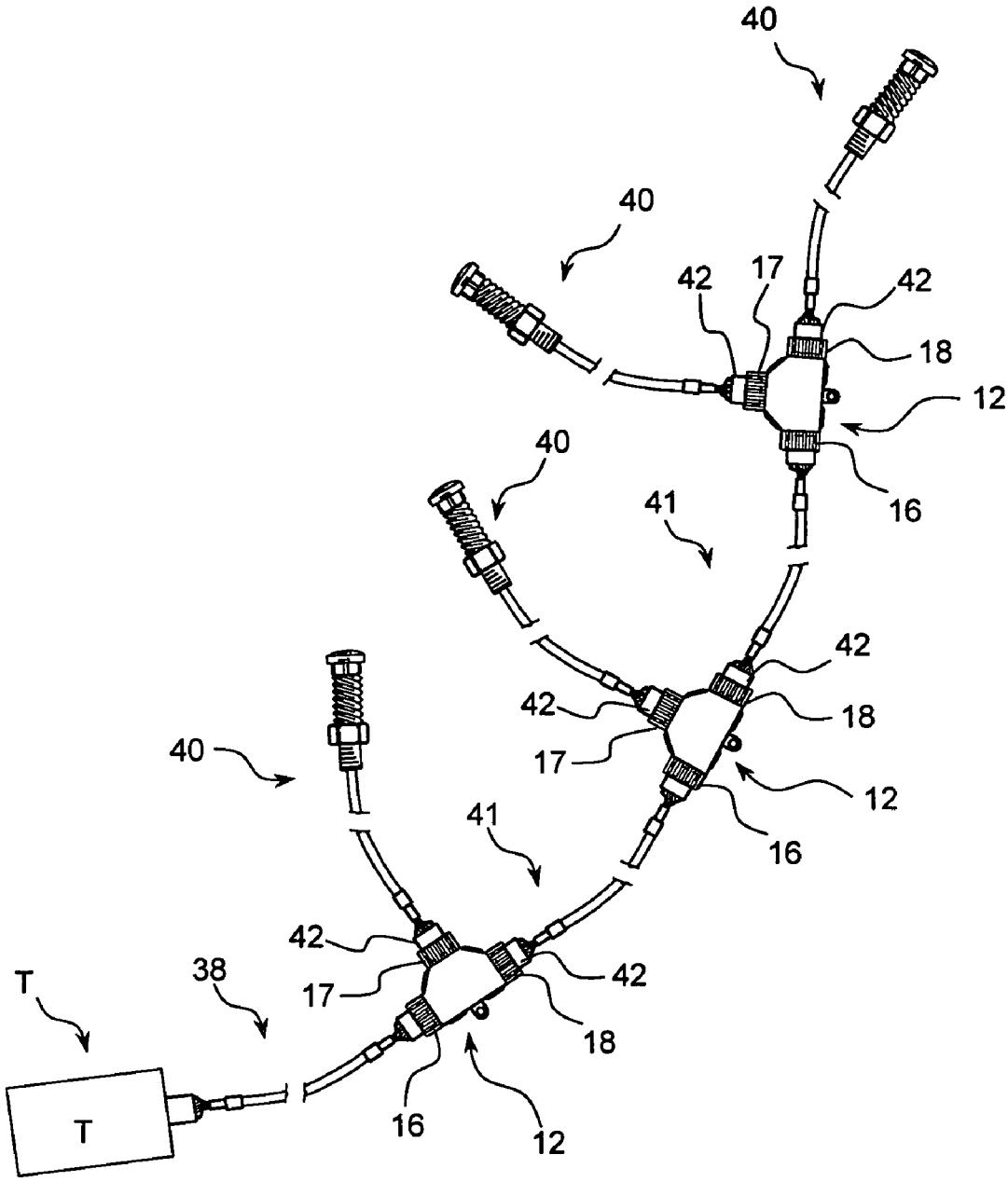
FIG. 3 is a top view of the system shown in FIG. 1, further including additional junction hubs and additional light emitting diode subassemblies.

Turning now to FIG. 3, because the structure of the junction hub connectors 16, 17, 18 are identical to one another in the shown embodiment, it can be appreciated that the junction hub 12 may be coupled in series to other junction hubs 12 also having light emitting diode subassemblies connected thereto. The connection between the junction hubs is provided by an intermediary signal transmission cable 41 having connectors 42 on opposing ends thereof. As shown, the signal transmission cable 38 may be connectable to a signal transmitter T which may include or be connectable to a power source (not shown) such as an electrical outlet, transformer, controller, signal generator, battery, etc. which provides an electrical source for powering the system 10.

In some embodiments of the invention, connectors 42 and 16, 17 and 18 may include structure, such as an asymmetrical arrangement of male/female multiple pin connectors or other connectors that establish an electrical connection only when corresponding connectors are placed in a specifically aligned rotational orientation. For example, connectors 16, 17, 18 and connectors 42 may include registry or alignment surfaces, such as a tongue and groove, key and keyway, or other suitable arrangement, to prevent or deter connection of when the connectors are not properly orientated relative to one another. This feature of the invention is especially useful in systems of the invention wherein one or more light emitting diodes comprises a multiple color light emitting diode and the circuit board is effective to deliver specific control signals to cause the light emitting diode to emit different colors of light at different times or in a specific pattern.

It can be appreciated that the surface mounted lighting system 10 of the present invention is exceptionally versatile and can be variously arranged to provide a desired lighting effect in a pool, spa, fountain, waterfall or other structure.

Figure 4:
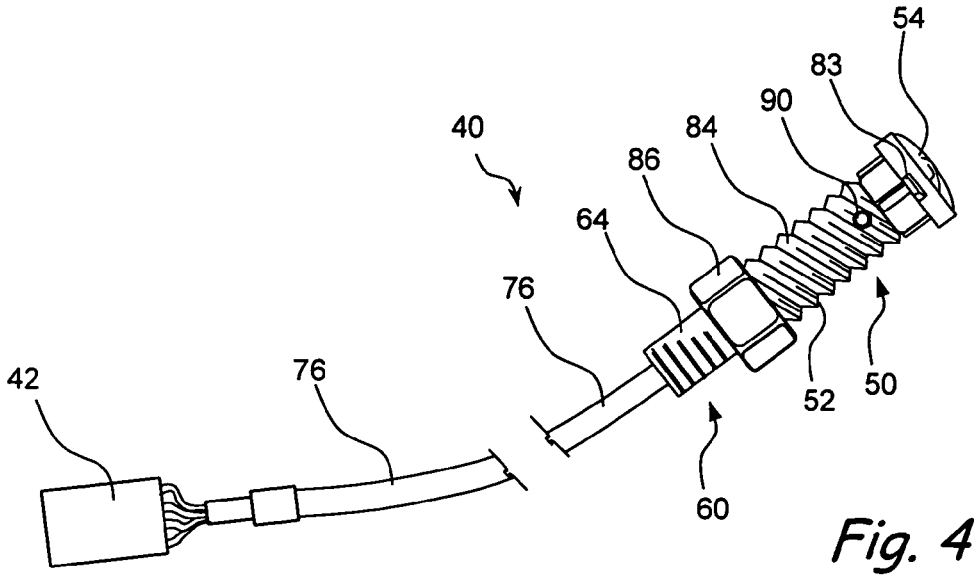
FIG. 4 is a top view of one of the light emitting diode subassemblies shown in FIGS. 1 and 3.
Figure 4C:
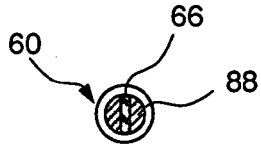
FIG. 4C is a cross sectional view of the light emitting diode subassembly taken across line 4C-4C of FIG. 4A.
Figure 4A:
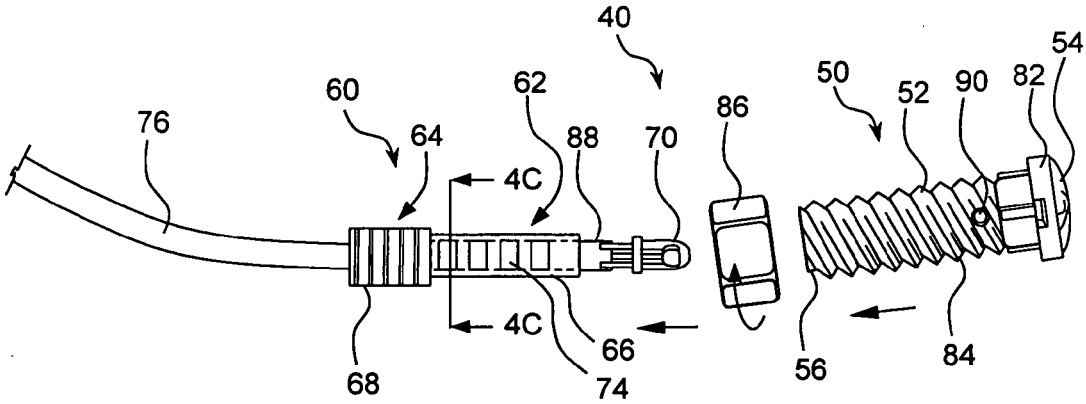
FIG. 4A is an exploded view of the light emitting diode subassembly shown in FIG. 4.
Figure 4B:
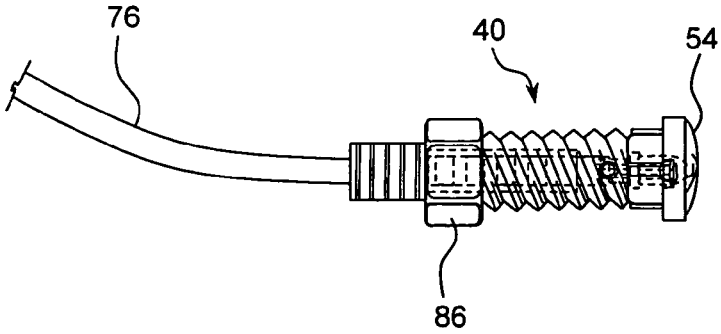
FIG. 4B is a view of the light emitting diode subassembly shown in FIG. 4, showing the position of a plug member positioned within a lens body.

Turning now to FIGS. 4-4B, the light emitting diode subassembly 40 will now be described in greater detail. In the shown embodiment, the light emitting diode subassembly comprises a lens member 50 comprising a generally tubular lens body 52 having a closed distal end 54 and an open proximal end 56. The light emitting diode subassembly 40 further comprises a plug member 60 having a distal end 62 and a proximal end 64. More specifically, plug member 60 may be a unitary molded structure having a distal portion 66 that fits within an opening in the lens body 52, and a relatively wider, enlarged basal portion 68 that abuts the proximal end 56 of the lens body. A light emitting diode 70 protrudes from the distal end 62 of the plug member 60. A connector cable 76 is attached to, for example, extends through, the basal portion 66 of the plug member 60. The cable 76 is connectable, for example, by means of connector 42, to one of the connectors of the junction hub (not shown in FIGS. 4-4B).

Referring now specifically to FIGS. 4A and 4B, the plug member 60 and light emitting diode 70 are insertable into the tubular lens body 52 such that the plug member 60 engages, for example, frictionally engages, an inner surface of the tubular lens body 50. Advantageously, the plug member engages the tubular lens body 52 to form a substantially liquid tight seal therebetween. Suitable frictional engagement may be effected by a close fit between the distal portion 68 of the plug member 60 and the inner surface of the lens body 52. Additionally, distal portion 68 of the plug member 60 may include ridges 74 or other structure to enhance the frictional fit between the two components. Plug member 60 may be comprised of any suitable moldable material having a suitable degree of flexibility and resiliency. For example, the plug member 60 may comprise a polypropylene, polyvinylchloride (PVC), natural or synthetic rubber, or the like material.

In another aspect of the invention, the basal portion 68 of the plug member 60 may be structured to perform a strain relief function to deter damage to or breakage of the connection between the connector cable 76 and the light emitting diode 70. For example, the basal portion 68 is shown as a relatively enlarged region of the plug member 60 surrounding a distal end of the connector cable 76. The basal portion 68 may have a degree of flexibility effective to absorb bending strain of which the light emitting diode subassembly 40 may be subjected during installation or maintenance of the present system 10.

The lens body 52 may be constructed of a relatively more rigid plastic material, for example, a clear or colored translucent plastic. The closed distal end 54 of the lens body 52 has a cap-like structure, or flange 82, as shown. Flange 82 may include one or more undercut regions 83 for receiving a screw driver or other flat element in order to facilitating removal of the light emitting diode subassembly 40 from a wall when it is desired to replace the light emitting diode. The lens body 52 includes a threaded outer surface 84 for receiving a nut 86 for enhancing tightness of fit between the flange 82 and an opposing surface of the wall to which the system 40 is installed. When the plug member 60 and lens body 52 are assembled as shown in FIG. 4B, the light emitting diode 70 will cast light outwardly through the closed distal end 54 of the lens body 52.

Referring back to FIG. 4A, the light emitting diode subassembly 40 may further comprise a connector circuit 88 extending substantially through the plug member 60 and providing an electrical connection between the connector cable 76 and the light emitting diode 70. The connector circuit 88 may be molded into, or otherwise permanently affixed to, the distal portion 66 of the plug member 60. FIG. 4C illustrates a cross-sectional view of the plug member 60 showing the connector circuit 88 located within the distal portion 66 of the plug member 60.

In yet another aspect of the invention, the light emitting diode subassembly 40 may include a heat dissipater or heat dissipating structure, for example a heat sink, for dissipating heat from the light emitting diode during use of the system 10. In the shown embodiment, a heat dissipater is provided which comprises an opening 90 or vent passage on the lens member 50, for example, at a location in the lens body 52 adjacent to the light emitting diode 70. This optional feature may be provided for deterring overheating and/or extending the functional life of the light emitting diode 70.

Optionally, the light emitting diode 70 may be monochromatic, emitting light of a single color. Alternatively, the light emitting diode 70 may be capable of alternately emitting light of different colors (e.g., white, red, green, blue, yellow, etc.) For example, one or more of the light emitting diodes may comprise a blue-yellow-green light emitting diode.

Figure 5A:
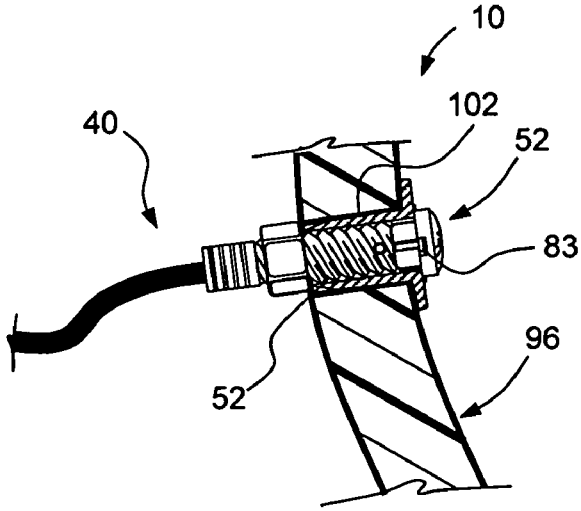
FIGS. 5A-5C are a step-wise schematic showing of one method for changing the light emitting diode subassembly in system of the present invention, while the system is installed in a wall of a spa, for example.
Figure 5B:
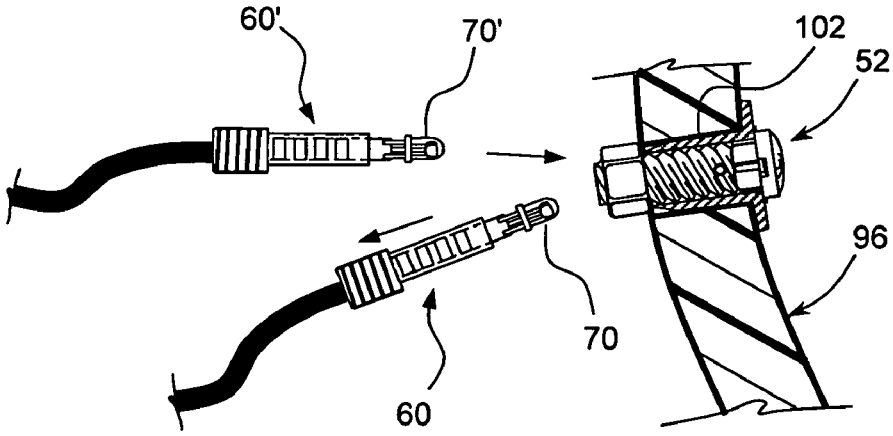
Figure 5C:
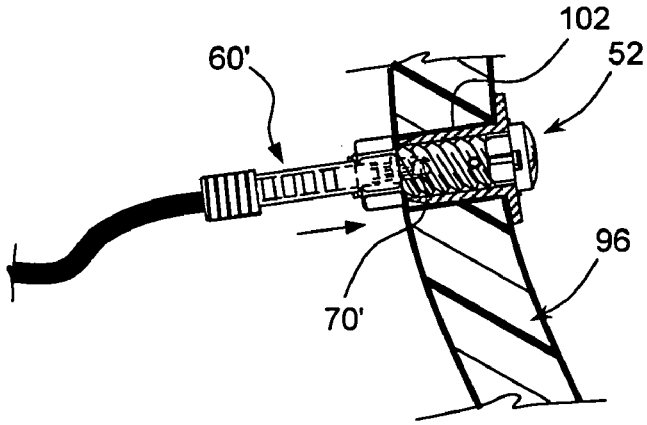

Turning now to FIGS. 5A-5C, the system 10 is structured to be easily and conveniently installed and maintained.

Connector 42 and connectors 16, 17, 18 are structured to facilitate removal and replacement of the light emitting diode subassembly 40. Replacement of the light emitting diode subassembly 40 may be necessary or desirable, for example, when the light emitting diode 70 fails or burns out, or when a user simply desires to substitute a light emitting diode with a different color, wattage or type of light emitting diode.

FIG. 5A shows a distal portion of the light emitting diode subassembly 40 as installed in a wall 96 of a pool, spa, waterfall, fountain, or other structure. To install the present system, a hole is formed in the wall 96 at the location where a light is desired. A cylindrical lining element 102 is fitted into the hole to form a liquid tight seal between the lining element 102 and the wall 96. The lens body 52 is inserted into the cylindrical lining element 102 from a front side of the wall 96 and the plug member 60 including the light emitting diode, is inserted into the open proximal end of the lens body 52. Nut 86 is tightened against distal end of lens body 52 to form a liquid tight seal.

FIGS. 5A-6B show examples of methods by which the system 10 may be mounted in a wall and whereby the light emitting diode subassembly 40 may be changed without having to access the rear or underside of the wall.

Specifically, FIGS. 5A-5C show in step-wise fashion one method for mounting the system 10 and changing the light emitting diode subassembly 40. In this method, the system 10 is inserted into an opening or bore formed in the wall 96. The outer surface of the lens body 52 may frictionally engage the surrounding surface of the wall within the hole or bore. Optionally, a seal 102, such as a silicone or plastic ring or tube, may be disposed between the outer surface of the lens body 52 and the surrounding surface of the wall 96 so as to facilitate the frictional engagement and/or to prevent fluid or moisture from passing through the hole or bore while the system 10 is installed therein.

FIG. 5B illustrates an old plug member 60 and light emitting diode 70 of the light emitting diode subassembly 40 which, when accessed from the backside of the wall 96, has been removed from the lens body 52 which remains in the wall 96. A new plug member 60' and light emitting diode 70' are inserted in its place, as shown in FIG. 5C.

FIGS. 6A-6D illustrate in step-wise fashion, an examples of methods by which the system 10 may be mounted in a wall and whereby the light emitting diode subassembly 40 may be changed without having to access the rear or underside of the wall 96.

Figure 6A:
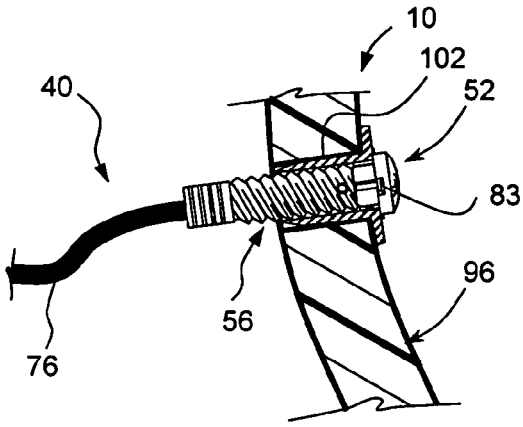
FIGS. 6A-6D illustrates an alternative method of replacing the light emitting diode in the system while the system is installed in a wall of a spa, for example.
Figure 6B:
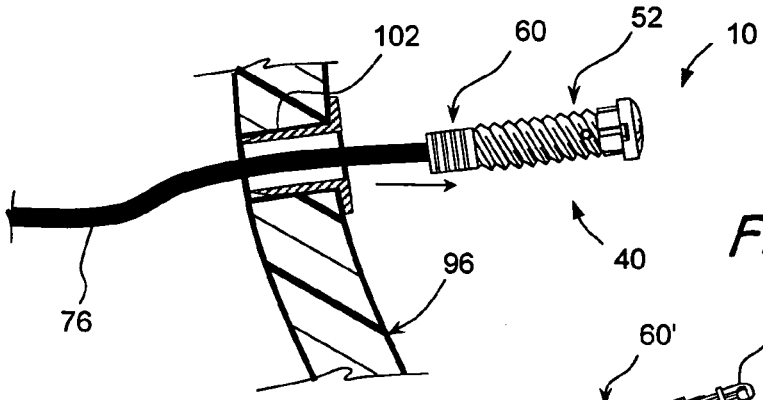
Figure 6C:
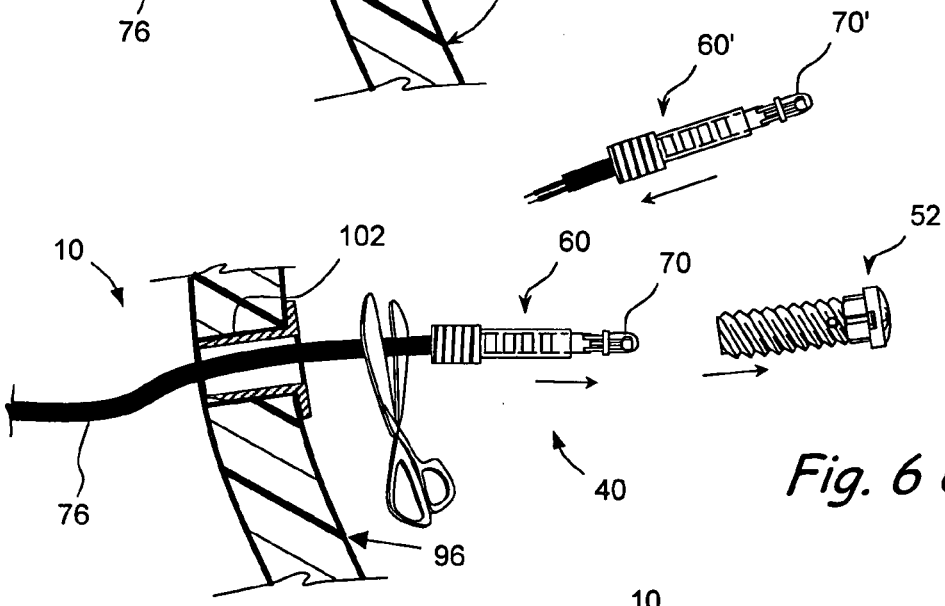
Figure 6D:
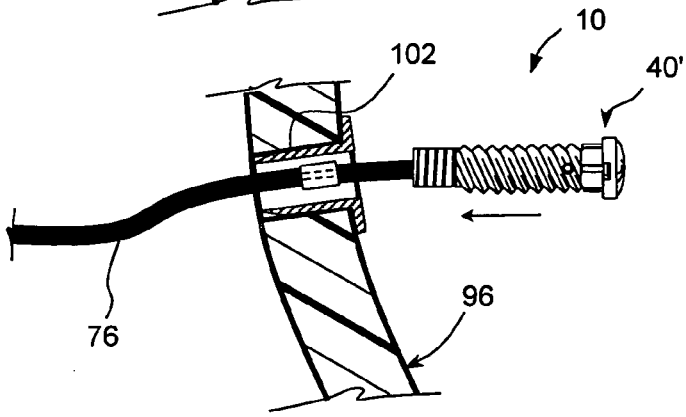

Specifically, FIGS. 6A-6D show how the light emitting diode subassembly 40 is inserted into an opening or bore formed in the wall 96. FIG. 6A shows the outer, threaded surface of the lens body 56 frictionally engaged with the surrounding surface of the wall within the hole or bore. Optional seal 102 is disposed between the outer surface of the lens body 52 and the surrounding surface of the wall 96 in a fluid tight fashion. In this example, connector 42 (not shown) of the light emitting diode subassembly 40 is not electrically connected to the signal transmitter or power supply, and the cable 76 and/or other electrical transmission member(s) are sufficiently long to allow the system 10 to be pulled out of the hole or bore by grasping or engaging the lens cap 52 from the front side of the wall, (e.g. this may be facilitated inserting a screw driver or similar device into optional undercut area(s) 83 formed in the periphery of the lens cap 52), and pulling the lens body 56 and plug member 60 outward as shown in FIG. 6B. The cable 76 is cut as shown in FIG. 6C and a new light emitting diode subassembly is wired to the cut end of the cable 76. The original light emitting diode subassembly distal portion 40 is discarded. The new light emitting diode subassembly 40' is pushed back into the hole in the wall as shown in FIG. 6D. Thus, in this manner, the lens cap/LED/first connector subassembly 18 may be changed without need to access the back side of the wall 96.

In embodiments where the connectors 16, 17, 18 and connectors 42, must be in specifically aligned rotational orientations in order to be properly connected, the operator may rotate the subassembly 40 while applying gentle forward pressure until the connectors become properly oriented and engage one another.

It is to be appreciated that the invention has been described herein with reference to certain examples or embodiments of the invention but that various additions, deletions, alterations and modifications may be made to those examples and embodiments without departing from the intended spirit and scope of the invention. For example, any element or attribute of one embodiment or example may be incorporated into or used with another embodiment or example, unless to do so would render the embodiment or example unsuitable for its intended use. All reasonable additions, deletions, modifications and alterations are to be considered equivalents of the described examples and embodiments and are to be included within the scope of the following claims.

What is claimed is:

1. A light emitting diode system comprising:

a junction hub comprising a hub body having first, second and third connectors and a circuit board;

the first connector being connected to a signal transmission cable that transmits a signal to the junction hub;

the second connector being connected to a light emitting diode subassembly; and the third connector being connected to one of a) a light emitting diode subassembly and b) a signal transmission cable that transmits the signal from the junction hub to another junction hub that has at least one other light emitting diode connected thereto;

wherein the circuit board of the junction hub is operative to cause the light emitting diodes to display of light serially.

2. A system according to claim 1 wherein the light emitting diode subassembly comprises:

a generally tubular lens body having a closed distal end and an open proximal end;

a plug member having a distal end and a proximal end;

a light emitting diode protruding from the distal end of the plug member; and a connector cable attached to the proximal end of the plug member, said cable being connectable to the first or second connectors of the junction hub;

the plug member and light emitting diode being insertable into the tubular lens body such that the plug member frictionally engages the inner surface of the tubular lens body and the light emitting diode casts light outwardly through the closed distal end of the lens body.

3. A system according to claim 1 wherein the plug member engages the generally cylindrical lens body to form a substantially liquid tight seal.

4. A system according to claim 3 wherein the plug member has a distal portion that inserts into the lens body and a basal portion against which the proximal end of the lens body bottoms out.

5. A system according to claim 4 wherein the connector cable extends through the basal portion of the plug member and wherein the basal portion of the plug member performs a strain relief function to deter breakage of the connection between the connector cable and the light emitting diode.

6. A system according to claim 2 wherein the light emitting diode subassembly further comprises a connector circuit which extends substantially through the plug member and forms an electrical connection between the connector cable and the light emitting diode.

7. A system according to claim 6 wherein the connector circuit comprises a light emitting diode board structured to provide a plug-in electrical connection between the connector cable and the light emitting diode.

8. A system according to claim 2 wherein the lens body includes a threaded portion.

9. A system according to claim 2 wherein the lens body comprises a distal portion including a radially extending flange.

10. A system according to claim 9 wherein the flange of the distal portion of the lens body includes structure to facilitate removal of the subassembly from a structure of which the system is installed.

11. A system according to claim 9 wherein the flange includes at least one cut out portion.

12. A system according to claim 1 further comprising a heat dissipater for dissipating heat from the light emitting diode.

13. A system according to claim 12 wherein the heat dissipater comprises a vent hole on the lens member.

14. A system according to claim 1 wherein the light emitting diodes are capable of emitting light of different colors and wherein the circuit board of the junction hub is operative to serially control the color of light emitted from the light emitting diodes.

15. A system according to claim 1 positioned within a panel, wall or other structure.

16. A system according to claim 15 wherein a substantially fluid tight seal is formed between the light emitting diode subassembly and the panel, wall or other structure.

17. A system according to claim 2 wherein at least one of the light emitting diodes of the light emitting diode subassemblies emits monochromatic light.

18. A system according to claim 2 wherein at least one of the light emitting diodes of the light emitting diode subassemblies is capable of emitting light of more than one color.

19. A system according to claim 2 wherein at least one of the light emitting diodes is a red-green-blue light emitting diode.

20. A system according to claim 15 wherein the panel, wall or other structure comprises a side, top or bottom wall of a swimming pool, spa, pond, whirlpool, hot tub, shower, steam room, bath tub, jetted bath tub, water fall, fountain or other structure that contains or receives vapor, water or other fluid.

* * * * *